US008322453B2

(12) United States Patent
Kikuchi et al.

(10) Patent No.: US 8,322,453 B2
(45) Date of Patent: Dec. 4, 2012

(54) SPRINKLER HEAD

(75) Inventors: Tetsuro Kikuchi, Iwate (JP); Rikiya Kato, Soka (JP)

(73) Assignee: Senju Metal Industry Co., Ltd., Tokyo (JP)

( * ) Notice: Subject to any disclaimer, the term of this patent is extended or adjusted under 35 U.S.C. 154(b) by 0 days.

(21) Appl. No.: 11/989,696

(22) PCT Filed: Aug. 2, 2005

(86) PCT No.: PCT/JP2005/014066
§ 371 (c)(1),
(2), (4) Date: Sep. 9, 2008

(87) PCT Pub. No.: WO2007/015291
PCT Pub. Date: Feb. 8, 2007

(65) Prior Publication Data
US 2009/0114404 A1 May 7, 2009

(51) Int. Cl.
*A62C 37/12* (2006.01)
*A62C 37/08* (2006.01)
*A62C 37/36* (2006.01)
*A62C 37/10* (2006.01)

(52) U.S. Cl. ..... 169/57; 169/38; 169/42; 169/59; 169/60

(58) Field of Classification Search ..... 169/57, 169/37, 38, 42, 56, 59, 60; 239/75
See application file for complete search history.

(56) References Cited

U.S. PATENT DOCUMENTS

| | | | | |
|---|---|---|---|---|
| 3,393,746 | A * | 7/1968 | Hodnett | 169/41 |
| 4,532,996 | A * | 8/1985 | Wilson et al. | 169/23 |
| 4,805,701 | A * | 2/1989 | Mountford | 169/57 |
| 5,368,265 | A * | 11/1994 | Gueli | 248/214 |
| 6,439,315 | B2 * | 8/2002 | Onuki | 169/37 |
| 6,554,077 | B2 * | 4/2003 | Polan | 169/57 |
| 6,843,199 | B2 * | 1/2005 | Abe et al. | 116/106 |
| 2002/0011527 | A1 * | 1/2002 | Onuki | 239/75 |

FOREIGN PATENT DOCUMENTS

| | | |
|---|---|---|
| EP | 1 821 015 | 8/2007 |
| JP | 2002-78815 | 3/2002 |
| JP | 2005-63792 | 3/2005 |

OTHER PUBLICATIONS

Supplementary European Search Report issued Dec. 29, 2009 in corresponding European Patent Application No. 05 76 8623.
International Search Report issued Nov. 15, 2005 in the International (PCT) Application of which the present application is the U.S. National Stage.

* cited by examiner

*Primary Examiner* — Jason J Boeckmann
*Assistant Examiner* — Steven M Cernoch
(74) *Attorney, Agent, or Firm* — Wenderoth, Lind & Ponack, L.L.P.

(57) ABSTRACT

A sprinkler head adapted for a specific yield temperature. The sprinkler head uses a heat-sensitive material composed of Sn in an amount of 0.1-2.0% by mass, Bi in an amount of 31-37% by mass and In for balance for a temperature range around 70-75° C. or a heat-sensitive material composed of Zn in an amount of 0.05-0.4% by mass, Bi in an amount of 43-55% by mass and In for balance for a temperature range around 90-95° C.

6 Claims, 1 Drawing Sheet

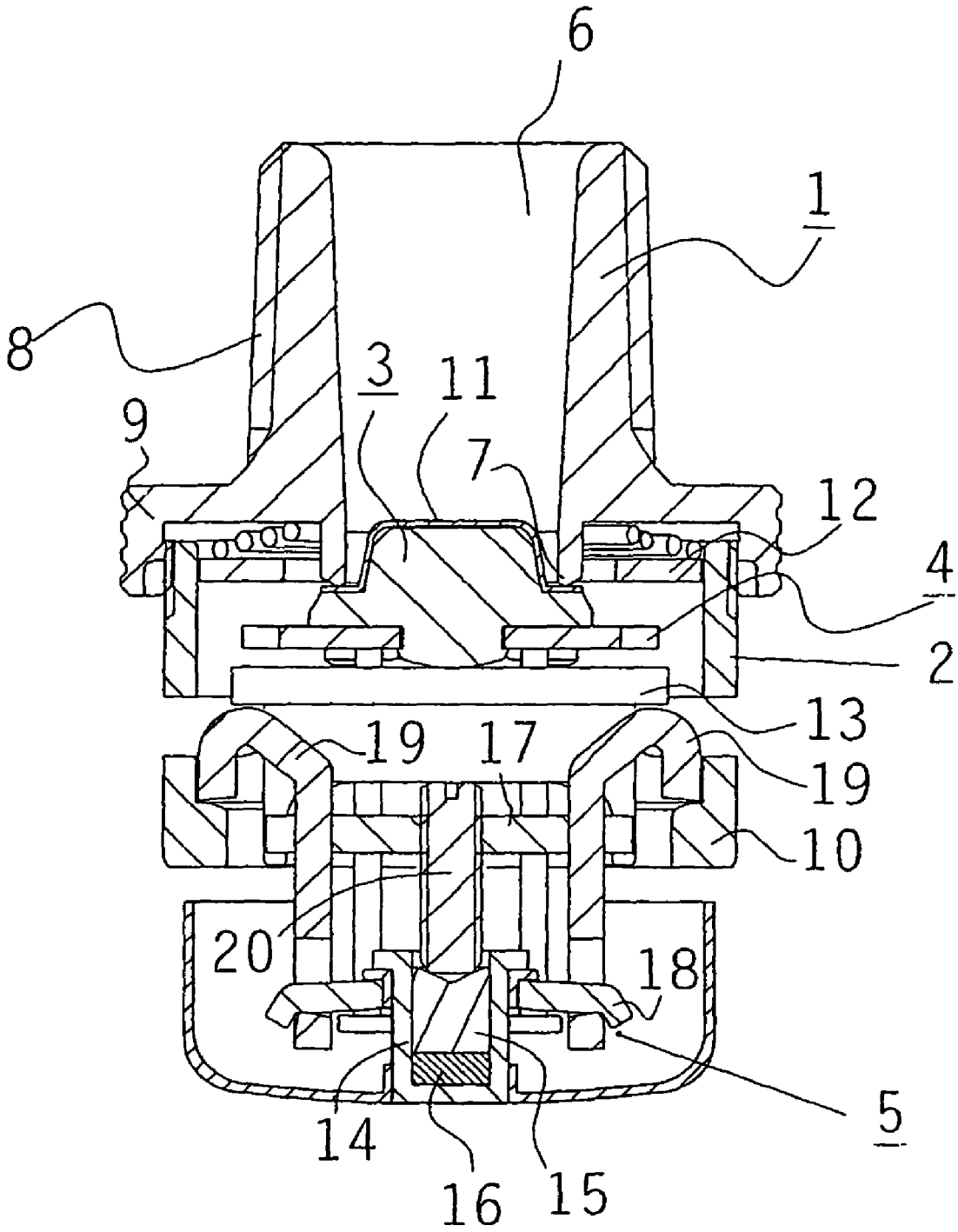
6
1
8
3
11
9
7
12
4
2
13
19
17
19
10
20
18
5
14
16
15

SPRINKLER HEAD

BACKGROUND OF THE INVENTION

1. Technical Field

The present invention relates to a sprinkler head which is activated in an event of fire to disperse water around for extinguishing a fire.

2. Description of the Related Art

A sprinkler head is configured such that a heat-sensitive decomposition structure of the sprinkler head is decomposed due to an unusually high temperature from a fire to release a valve element which is previously held in position by the heat-sensitive decomposition structure to allow water to be dispersed around for extinguishing a fire. A heat-sensitive material usable for the heat-sensitive decomposition structure of the sprinkler head may include a liquid and a low-melting point alloy.

When the liquid is used for the heat-sensitive decomposition structure in the sprinkler head, an alcohol may be employed as the heat-sensitive material. The heat-sensitive decomposition structure using the alcohol is referred to as a glass bulb type, in which an amount of alcohol, together with a small volume of air, is loaded in an ampule made of glass. In the structure of the glass bulb type, the ampule as described above is placed between a valve element and a main body of a sprinkler head to thereby support the valve element. In the structure of the glass bulb type, when a fire breaks out, the alcohol contained in the ampule is excited to come to a boil and thus evaporate, which in turn increases an internal pressure of the ampule and ultimately destroys the ampule. Consequently, this can release the valve element that has been held by the ampule. Although the structure of the glass bulb type is inexpensive and efficient, since this structure employs a mechanism in which the alcohol contained in the ampule is evaporated and the resultantly increased pressure destroys the ampule, only a small variation in the thickness and strength of the ampule, the amount of contained alcohol, the amount of contained air or the like may lead to a variation in time period until the destruction of the ampule; therefore a lack of stability is a concern in that the glass bulb type could not be always successfully activated at a predetermined temperature.

In the sprinkler head according to the prior art that has employed the low-melting point alloy for the heat-sensitive decomposition structure, the low-melting point alloy, when used as the heat-sensitive decomposition structure, can exhibit a superior property that it would introduce little variation in the activation timing, owing to the fact that the low-melting point alloy has a specific melting point depending on a specific composition or a compounding ratio of components of the alloy. The heat-sensitive decomposition structure using the low-melting point alloy includes a wrap joint type and a compression type.

The wrap joint type of heat-sensitive decomposition structure may refer to one that comprises two sheets of metals in an oval configuration that have been bonded together with the low-melting alloy. In the wrap joint type of heat-sensitive decomposition structure, the respective metal sheets at their ends are engaged with levers, with one of the levers holding the valve element, while the other of the levers is placed in abutment with the main body of the sprinkler head for supporting a pressing force against the valve element. In the sprinkler head incorporated with the heat-sensitive decomposition structure of the wrap joint type, when a fire breaks out, the low-melting point alloy is melted by the heat from the fire, and the metal sheets are separated to disengage the levers, so that the valve element is released to be open. Advantageously, the heat-sensitive decomposition structure of the wrap joint type, in which the heat-sensitive material employs the low-melting point alloy, can be activated more precisely with regard to the yield temperature, while on the other hand, it problematically lacks long-term reliability. That is, the heat-sensitive decomposition structure is always under a force to keep the valve element closed, as well as to provide a spring force to push the heat-sensitive decomposition structure sufficiently away so as not to interfere with a sprinkling operation when it is activated. However, the heat-sensitive decomposition structure of the wrap joint type, owing to its configuration that the two metal sheets are bonded together with the low-melting point alloy, could lead to peeling-off in the site of bonding due to the creeping phenomenon over a long time period.

The compression type of heat-sensitive decomposition structure may be such that the low-melting point alloy is loaded into a cylinder and further is pressed by a plunger, in which the cylinder and the plunger are configured to hold the valve element via other components or to engage the valve element to the main body. In the sprinkler head incorporated with the heat-sensitive decomposition structure of the compression type, when a fire breaks out, the low-melting point alloy is melted to allow the plunger sink into the cylinder, which in turn breaks the balancing between the components of the heat-sensitive decomposition structure to disengage them from one another, so that the valve element can be released to open. Advantageously, the heat-sensitive decomposition structure of the compression type, in which the heat-sensitive material employs the low-melting point alloy similarly to the wrap joint type, can be activated precisely with regard to the yield temperature, and additionally, owing to its configuration that the low-melting point alloy is filled in the cylinder and pressed by the plunger, the heat-sensitive decomposition structure of the compression type would not exhibit such a creeping phenomenon that could deform the low-melting point alloy, even if the low-melting point alloy is placed under strong compression force over a long time period. In view of those advantages as pointed out above, recently, the use of the heat-sensitive decomposition structure of the compression type has become mainstream.

The sprinkler heads employ a low-melting point alloy which is suitable for the specific location where the sprinkler head is placed. For example, the sprinkler head to be placed in an ordinary building, such as a high-rise apartment building or a department store, may employ such a low-melting point alloy having a relatively lower melting point in a range of 70-75° C. in order to be activated as quickly as possible to provide an initial stage extinction. In this regard, even in the ordinary building, specifically at a location above a stove burner in a kitchen or adjacent to a hot air outlet of a heating apparatus, the use of the low-melting point alloy having the melting point as low as 70-75° C. may lead to problematic situations. For example, when the temperature of the environment around the sprinkler head rises proximally to the melting point, the sprinkler head would be undesirably activated to disperse the water around, in spite of no fire being recognized, or when the temperature rises not as high as the melting point or higher but at least nearly to the melting point of the low-melting point alloy, the mechanical strength of the low-melting point alloy would be extremely decreased. Accordingly, it may cause the separation of the two metal sheets in the wrap joint type, or the softened low-melting point alloy to be crushed in the compression type. To avoid the problems as mentioned above, the low-melting point alloy having the melting point in a range of 90-100° C. is used at a location subject to a rising temperature, such as those in a kitchen or adjacent to a hot air outlet of a heating apparatus.

In the sprinkler head according to the prior art, most of the low-melting point alloys used in the heat-sensitive decomposition structure are those containing Pb or Cd. For example, the low-melting point alloy having the melting point in a range of 70-75° C. may be represented by 50Bi-12.5Cd-25Pb-12.5Sn (melting point at 72° C.) and the low-melting point alloy having the melting point in a range of 90-100° C. may be represented by 52Bi-32Pb-16Sn (melting point at 96° C.)

If should be noted that, the sprinkler head, in general, is kept installed as it is in the building as long as no fire occurs, but is replaced with a new one when it brings about unpleasant exterior appearance or it no more satisfies the authorized design rules, and those old ones may be scrapped. However, disposed sprinkler heads could cause pollution of underground water due to the Pb or Cd used in the heat-sensitive material for the heat-sensitive decomposition structure of the sprinkler head. If human beings drink the underground water containing the Pb or Cd over many years, undesirably the Pb or Cd are accumulated in a human body and possibly lead to lead or cadmium poisoning. In consideration of the above fact, there has been a demand for the sprinkler head comprising the heat-sensitive material completely free from the Pb or Cd in the construction industry as well as in the fire control equipment industry.

The applicant of the present invention had proposed an innovative sprinkler head characterized in using no Pb or Cd in the heat-sensitive material for the heat-sensitive decomposition structure, but employing a low-melting point alloy for the heat-sensitive decomposition structure, which comprises two or more metals selected from a group consisting of Sn, Bi, In, Zn, Ga and Ag (Japanese Patent Laid-open publication No. 2002-078815).

SUMMARY OF THE INVENTION

When a solder alloy is used in the heat-sensitive decomposition structure of the sprinkler head, specific low-melting point alloy must be employed depending on a prescribed yield temperature at which the sprinkler is to be activated. For a Sn-based solder alloy used in the heat-sensitive decomposition structure of the sprinkler head, additives for lowering the yield temperature may include, in the form of elements, Pb, Cd, Bi, In and Zn. As discussed above, since Pb and Cd are banned for the reason that they could cause the pollution of underground water, specifically the In from the remaining elements Sn, Bi, In and Zn should preferably be used as a base material to form a solder alloy composition, as the In has a particularly low melting point. However, since the In is relatively soft and thus has a poorer creeping property, the heat sensitive material for the heat sensitive decomposition structure of the sprinkler head that is formed from an In-based alloy without using the Pb or Cd has exhibited a poorer creeping property, thereby leading to a deteriorated durability of the sprinkler head, as compared to those using the Pb or Cd. Especially, the heat-sensitive material for the heat-sensitive decomposition structure of the sprinkler head using the Cd generally has a better creeping property and thus exhibits relatively better durability as compared to those constructed with the heat-sensitive material using no Pb or Cd.

The sprinkler head has its technical standard officially designated under the ministerial ordinance from the Ministry of Public Management. The ordinance imposes, for example, such a strength test that the sprinkler head designed to be used in an environment with a temperature range of 70-75° C. should be left at a testing temperature of 52° C., or the one designed to be used in the temperature range of 90-100° C. should be left at the testing temperature of 80° C., for 30 days, and then placed under a static pressure at 2.5 MPa for 5 minutes. In this connection, the sprinkler head made of the In-based alloy without using Pb or Cd tends to exhibit poorer creeping property as compared to the one using Pb or Cd according to the prior art. The creeping is defined as a deformation that proceeds with time under a constant load or a constant stress, and a property representing less tendency of the time-dependent deformation is referred to as a good creeping property. The creeping property generally appears better for a hard material and worse for a soft material.

Especially, since a testing temperature in a strength test of a sprinkler head is proximal to a melting temperature of a solder alloy used in a heat-sensitive decomposition structure of the sprinkler head, a good creeping property over a higher temperature zone in which a sprinkler is activated is required. However, typically, the sprinkler head made of the In-based alloy with no use of Pb or Cd could not achieve an excellent creeping property over the higher temperature zone in which the sprinkler is activated as compared to any conventional sprinkler head using Pb or Cd, and could occasionally end up in failure in a durability test.

A problem to be solved by the present invention is to provide a sprinkler head that can exhibit a good creeping property and thus a favorable durability for a higher temperature zone in which the sprinkler is activated, yet using an In-based heat-sensitive material with no use of PB or Cd.

The applicants of the present invention, after having made a keen examination on a defect of a heat-sensitive material for a heat-sensitive decomposition structure with no use of Pb or Cd, which have a solid phase temperature and a peak temperature in a range of 65-75° C. and in a range of 90-100° C., have made the present invention by finding the following facts. That is, a certain alloy composition having a limited range of composition for the Bi—In—Sn alloy can have the solid-phase temperature and the peak temperature in a range of 70-75° C. and in a range of 90-95° C., both falling in a narrowly limited zone, and also can exhibit a good creeping property over a higher temperature zone in which the sprinkler head is activated. In addition, advantageously, the heat-sensitive material for the heat-sensitive decomposition structure of the sprinkler head of the present invention contains no Cd or Pb or toxic substance, in nature.

A heat-sensitive material having a melting temperature in a range of 70-75° C. according to the present invention is an alloy usable for a heat-sensitive material for a heat-sensitive decomposition structure of the sprinkler head, said alloy being characterized in that it is composed of Sn in an amount of 0.1-2.0% by mass, Bi in an amount of 31-37% by mass and In for balance.

Further, heat-sensitive material having a melting temperature in a range of 90-95° C. according to the present invention is an alloy usable for a heat-sensitive material for a heat-sensitive decomposition structure of the sprinkler head, said alloy being characterized in that it is composed of Zn in an amount of 0.05-0.4% by mass, Bi in an amount of 43-55% by mass and In for balance.

An alloy adopted in a heat-sensitive material for a heat-sensitive decomposition structure of a sprinkler head of the present invention contains no toxic substances, such as Cd and Pb, and is free from a risk that an old sprinkler head would pollute underground water, as it is replaced with a new one and put into landfill disposal. Further, since the sprinkler head of the present invention exhibits a good creeping property over a higher temperature zone in which the sprinkler head is activated, a long operating life of the sprinkler head is achieved without exchanging the sprinkler heads, and so the present invention can provide an excellent sprinkler head without any concern about failing in the durability test.

BRIEF DESCRIPTION OF THE DRAWINGS

FIG. 1 is a front sectional view of a sprinkler head incorporated with a heat-sensitive decomposition structure of a compression type.

Components in the attached drawing are designated as follows:

1 Main body
2 Frame
3 Valve element
4 Deflector
5 Heat-sensitive decomposition structure
14 Cylinder
15 Plunger
16 Low-melting point alloy

DETAILED DESCRIPTION OF THE INVENTION

A sprinkler head is typically dependent on a temperature at which an alloy used for the sprinkler head is melted and which is always subject to a water pressure. Therefore, it could fail to work as a safety apparatus if it has a lower mechanical strength, including a creeping property and the like. For a Bi—In—Sn-based alloy of the present invention having a solid-phase and peak temperature around 70-75° C., if the Sn is included in an amount less than 0.1% by mass, it may produce a low mechanical strength of the alloy in itself, resulting in failure in the strength test. In contrast, if the Sn is included in an amount more than 2.0% by mass, it may produce a lower solid-phase temperature of the Bi—In—Sn-based alloy and thus the melting temperature of the alloy approaches a temperature zone in which the sprinkler head is used, which may deteriorate the strength of the alloy and impair creeping property over a yield temperature zone. For the reasons pointed out above, preferably, the Sn content may be in a range of 0.1-2.0% by mass in the Bi—In—Sn-based alloy of the present invention. In addition, if a Bi content is less than 31% by mass, it may excessively increase a liquid-phase temperature of the Bi—In—Sn-based alloy, which will adversely affect the melting property of the alloy, resulting in failure in the melting test. If the Bi content is more than 37% by mass, it may divert from the eutectic point of the Sn—In alloy, and consequently the liquid-phase temperature will be excessively raised and adversely affect the melting property of the alloy, again resulting in failure in the melting test. For the reasons pointed out above, preferably, the Bi content may be in a range of 31-37% by mass in the Bi—In—Sn-based alloy of the present invention. The present invention provides the alloy suitable for the sprinkler head, which has a favorable creeping property over the temperature zone of 70-75° C., in which the sprinkler head is used, by preparing the alloy which includes the Sn in an amount of 0.1-2.0% by mass, the Bi in an amount of 31-37% by mass and the In for balance. More preferably, if the alloy includes the Sn in an amount of 0.5% by mass, the Bi in an amount of 35% by mass and the In for balance, it can provide the alloy suitable for the sprinkler head, which has a most favorable creeping property over the temperature zone in which the sprinkler head is used. If the contents of the basic substance or Sn or Bi of the alloy for the sprinkler head of the present invention diverts from the composition as specified above, the melting temperature zone will extend, which will impair activation stability.

Now, for a Bi—In—Zn-based alloy of the present invention, which has the solid-phase and peak temperature around 90-95° C., if the Zn is included in an amount less than 0.05% by mass, it may produce a lower mechanical strength of the alloy in itself, resulting in failure in the strength test, while in contrast, if the Zn is included in an amount more than 0.4% by mass, it may produce a lower solid-phase temperature of the Bi—In—Zn-based alloy and thus the melting temperature of the alloy approaches a temperature zone in which the sprinkler head is used, resulting in an impaired creeping property over the yield temperature zone. For the reason pointed out above, preferably the Zn content may be in a range of 0.05-0.4% by mass in the Bi—In—Zn-based alloy of the present invention. In addition, if the Bi content is less than 43% by mass in the Bi—In—Zn-based alloy of the present invention, it may excessively raise a liquid-phase temperature of the Bi—In—Zn-based alloy, which will adversely affect the melting property of the alloy, resulting in failure in the melting test. Further, if the Bi content is more than 37% by mass, it may divert from the eutectic point of the Sn—In alloy, and consequently the liquid-phase temperature will be excessively raised, which will adversely affect the melting property of the alloy, again resulting in failure in the melting test. For the reasons pointed out above, the Bi content is preferably in a range of 43-55% by mass in the Bi—In—Zn-based alloy of the present invention. The present invention provides the alloy suitable for the sprinkler head, which has a favorable creeping property, by preparing the alloy including the Zn in an amount of 0.05-0.4% by mass, the Bi in an amount of 43-55% by mass and the In for balance. More preferably, the alloy which includes the Zn in an amount of 0.2% by mass, the Bi in an amount of 48% by mass and the In for balance can provide the alloy suitable for the sprinkler head, which has a most favorable creeping property over the temperature in which the sprinkler head is used. If the content of the basic substance or Zn or Bi of the alloy for the sprinkler head of the present invention diverts from the composition as specified above, the melting temperature zone will extend, which will impair activation stability of the sprinkler head.

In addition, for the Bi—In—Sn-based alloy and the Bi—In—Zn-based alloy of the present invention, an element for improving the strength, such as Cu, Sb, Ge, Ag, Au, Zn Ni and La group, may be added thereto. The La group is also referred to as lanthanoid and includes, in addition to La, those elements having similar property to the La, such as Ce, Pr, Nd, Pm, Eu, Tb, Dy, Ho, Er, Tm, Yb and Lu. These elements for improving the strength, whether used alone or in combination, may work effectively. Especially, by adding Cu as the element for improving the strength, it can improve the creeping property most in the Bi—In—Sn-based alloy and the Bi—In—Zn-based alloy of the present invention. It is to be remembered in this regard that those elements must be used as they have been melt-mixed into the Bi—In—Sn-based alloy or the Bi—In—Zn-based alloy, and any excessive addition of those elements will raise the melting temperature of the alloy. Accordingly, it is preferred that a total amount of the elements to be added for improving the strength may be no more than 2% by mass. Most preferred amounts for respective elements to be added for improving the strength are 0.1-1.0% by mass for the Cu, 0.2-2.0% by mass for the Sb, 0.1-1.0% by mass for Ge, 0.1-0.7% by mass for Ag, 0.1-0.6% by mass for Au, 0.2-0.6% by mass for Zn, 0.02-0.1% by mass for Ni and 0.01-0.1% by mass for La group. Any lesser amounts than those listed above would not work sufficiently to improve the strength of the alloy, while any excessive amounts of additives than those listed above would raise the liquid-phase temperature and prevent the sprinkler head from being activated in a targeted temperature zone.

EXAMPLE 1

An alloy usable for a heat-sensitive material for a heat-sensitive decomposition structure of a sprinkler head of the present invention and a sprinkler head using the same alloy were fabricated.

Alloys usable for the heat-sensitive material for the heat-sensitive decomposition structure of the sprinkler head, as listed in Table 1 and Table 2, were prepared, and heating curve for respective alloy compositions were obtained via differential thermal analysis, where a starting point of an endothermic peak, a lowest point of the endothermic peak and an ending point of the endothermic peak were measured to determine a solid-phase temperature, a peak temperature and a liquid-phase temperature, respectively. The melting temperatures for respective alloys are presented in Table 1 and Table 2.

Comparative example 1 in Table 1 and Table 2 represents an alloy usable for a heat-sensitive material for a heat-sensitive decomposition structure of a sprinkler head from the cited Patent document 1.

The melting temperature was measured under the following conditions:

1. Measurements by the differential thermal analysis

Measuring apparatus for the differential thermal analysis: a differential scanning calorimeter manufactured by SII.

Temperature rising rate: 5 deg/min

Sample weight: 10 mg

In the following tables, Re. is a balance.

TABLE 1

| | Alloy composition (% by mass) | | | | | | | | | | | Melting tem. (° C.) | | | Strength test | Operation test |
|---|---|---|---|---|---|---|---|---|---|---|---|---|---|---|---|---|
| Examples | In | Bi | Sn | Cu | Sb | Ge | Ag | Au | Zn | Ni | La | Solid phase | Peak | Liquid phase | (mm) | (° C.) |
| 1 | Re. | 31 | 0.1 | | | | | | | | | 72 | 73 | 77 | 0.6 | 73 |
| 2 | Re. | 31 | 0.3 | | | | | | | | | 72 | 73 | 75 | 0.55 | 73 |
| 3 | Re. | 35 | 1 | | | | | | | | | 71 | 72 | 73 | 0.4 | 72 |
| 4 | Re. | 37 | 0.5 | | | | | | | | | 70 | 71 | 77 | 0.35 | 72 |
| 5 | Re. | 35 | 0.1 | 0.1 | | | | | | | | 72 | 73 | 75 | 0.2 | 73 |
| 6 | Re. | 35 | 0.5 | 0.5 | | | | | | 0.1 | | 71 | 72 | 77 | 0.2 | 73 |
| 7 | Re. | 37 | 2 | 1 | | | | | | 0 | | 70 | 71 | 76 | 0.2 | 72 |
| 8 | Re. | 35 | 0.5 | | 1 | | | | | | | 72 | 73 | 76 | 0.2 | 73 |
| 9 | Re. | 35 | 0.5 | | | 0.3 | | | | | | 71 | 72 | 74 | 0.2 | 72 |
| 10 | Re. | 35 | 0.5 | | | | 0.5 | | | | | 71 | 72 | 77 | 0.15 | 74 |
| 11 | Re. | 35 | 0.5 | | | | | 0.3 | | | | 72 | 73 | 75 | 0.35 | 72 |
| 12 | Re. | 35 | 0.5 | | | | | | 0.2 | | | 72 | 73 | 76 | 0.25 | 73 |
| 13 | Re. | 35 | 0.5 | 0.5 | 1 | | 0.3 | | | | 0.1 | 72 | 73 | 76 | 0.15 | 73 |
| Comparative eg. | | | | | | | | | | | | | | | | |
| 1 | Re. | 34 | | | | | | | | | | | | | 1.1 | 73 |
| 2 | Re. | 31 | 4 | | | | | | | | | 63 | 64 | 71 | 0.4 | 64 |
| 3 | Re. | 38 | 0.3 | | | | | | | | | 71 | 73 | 80 | 0.15 | 78 |
| 4 | Re. | 35 | 0.5 | 1 | 1 | | 1 | | | | | 71 | 73 | 106 | 0.15 | 82 |

TABLE 2

| | Melting tem. (° C.) | | | | | | | | | | Strength test (mm) | | | Strength test | Operation test |
|---|---|---|---|---|---|---|---|---|---|---|---|---|---|---|---|
| Examples | In | Bi | Zn | Cu | Sb | Ge | Ag | Au | Ni | La | Solid phase | Peak | Liquid phase | (mm) | (° C.) |
| 1 | Re. | 47 | 0.1 | | | | | | | | 89 | 92 | | 0.3 | 92 |
| 2 | Re. | 47 | 0.1 | | | | | | 0.1 | | 89 | 92 | 99 | 0.15 | 92 |
| 3 | Re. | 47 | 0.4 | | | | | | | | 89 | 92 | 95 | 0.15 | 93 |
| 4 | Re. | 48 | 0.2 | | | | | | | | 89 | 92 | | 0.2 | 92 |
| 5 | Re. | 55 | 0.4 | | | | | | | | 89 | 92 | 99 | 0.15 | 93 |
| 6 | Re. | 47 | 0.1 | 0.1 | | | | | 0.1 | | 89 | 92 | 94 | 0.15 | 92 |
| 7 | Re. | 48 | 0.2 | 0.5 | | | | | | | 89 | 92 | 94 | 0.2 | 92 |
| 8 | Re. | 55 | 0.4 | 1 | | | | | | | 89 | 92 | 99 | 0.15 | 95 |
| 9 | Re. | 48 | 0.2 | | 1 | | | | | | 89 | 92 | 96 | 0.1 | 93 |
| 10 | Re. | 48 | 0.2 | | | | 0.3 | | | | 89 | 92 | 94 | 0.15 | 92 |
| 11 | Re. | 48 | 0.2 | | | | | 0.5 | | | 89 | 92 | 99 | 0.15 | 94 |
| 12 | Re. | 48 | 0.2 | | | | | | 0.3 | | 89 | 92 | | 0.25 | 92 |
| 13 | Re. | 48 | 0.2 | 0.5 | 1 | | | 0.5 | | | 0.1 | 89 | 92 | 99 | 0.1 | 94 |
| Comparative eg. | | | | | | | | | | | | | | | | |
| 1 | Re. | 48 | | | | | | | | | 89 | 91 | | 0.6 | 92 |
| 2 | Re. | 48 | 1 | | | | | | | | 89 | 92 | 116 | 0.1 | 100 |
| 3 | Re. | 60 | 0.3 | | | | | | | | 89 | 92 | 105 | 0.15 | 98 |
| 4 | Re. | 48 | 0.5 | 1 | 1 | | | 1 | | | 89 | 92 | 118 | 0.1 | 102 |

EXAMPLE 2

The sprinkler head incorporated with the heat-sensitive decomposition structure of the compression type will herein be described in brief. FIG. 1 shows a front sectional view of a sprinkler head incorporated with the heat-sensitive decomposition structure of the compression type.

The sprinkler head S comprises a main body 1, a frame 2, a valve element 3, a deflector 4 and a heat-sensitive decomposition structure 5.

The main body 1 includes a water guide channel 6 extending though a center of the main body 1 and a valve seat 7 formed in a lower end thereof. An external thread 8 is provided in an outer surface of an upper portion of the main body 1, and a flange 9 is formed in a lower end of the main body 1.

The frame 2 is cylindrical and an internal flange 10 is formed in a lower end thereof. The upper end of the frame is threaded into the flange 9.

A gasket 11 is affixed over the valve element 3 and is operable to provide a seal for the valve seat 7 to be placed in a liquid-tight condition at ordinary times.

The deflector 4 has a disk-like shape with a number of vanes formed circumferentially and is adapted to be hung by a ring 12, when activated. The deflector 4 is arranged below the valve element 3 described above.

The heat-sensitive decomposition structure 5 is arranged below the frame 2 and holds the valve element 3 via a guide post 13.

The heat-sensitive decomposition structure 5 comprises a cylinder 14, a plunger 15, a low-melting point alloy 16, a support plate 17, a balance 18, a pair of levers 19, 19.

The cylinder 14 is filled with the low-melting point alloy 16 and the plunger 15 is placed against the low-melting point alloy 16. The cylinder 14 is fitted in a central bore of the balance 18 and respective ends of the balance are engaged in apertures of the levers 19, 19. A set screw 20 is placed on an upper portion of the plunger 15 and engaged in its top with the support plate 17. The levers 19, 19 are bent in its upper portions and engaged with the support plate 17 in the sites of bends. The levers 19, 19 have their bent ends placed on an internal flange 10 of the above-mentioned frame 2, and top ends of the bends are in abutment with the guide post 13.

EXAMPLE 3

In the next step, for the sprinkler head as shown in FIG. 1, the creeping property (hereinafter referred to as the strength test) for different alloy compositions and the yield temperature of the heat-sensitive decomposition structures incorporating therein respective alloy compositions were measured.

2. Strength Test

1.) The heat-sensitive decomposition structure 5 is incorporated in a special jig and introduced into a test bath, wherein the one with a temperature indication below 75° C. is introduced in the test bath set at 20° C., while the one with a temperature indication of 75° C. or higher is introduced into the test bath set at a temperature 20° C. below the maximum ambient temperature.

2.) A load thirteen times as large as an ordinary load is continuously applied to the heat-sensitive decomposition structure by a compressor for 240 hours, and then a variation in thickness of the heat-sensitive decomposition structure is measured.

3. Yield Temperature

1.) The sprinkler head is connected with the compressor and applied with a pressure of 2.5 MPa.

2.) The sprinkler head connected with the compressor is introduced into the bath, and the water in the bath is heated.

3.) The temperature at a time when the air has blown out of the sprinkler head at a burst is measured as the yield temperature.

The sprinkler head of the present invention can be activated respectively at the temperature around 70-75° C. or around 90-95° C., and exhibits a good creeping property for the sprinkler head alloy over a low temperature zone. Thus, the present invention can provide an advantageous effect that the sprinkler head of the present invention is operable over a long time period without failing in the strength test designated under the ministerial ordinance from the Ministry of Public Management that could not be achieved by the conventional low-melting point alloy containing no Cd or Pb.

The invention claimed is:

1. A sprinkler head adapted for a yield temperature in a range of 70-75° C., the sprinkler head being a compression type sprinkler head and including a main body defining a valve seat, a valve element normally seated on the valve seat, and a heat-sensitive decomposition structure connected to the valve element, the heat-sensitive decomposition structure including a metal cylinder, a heat sensitive material disposed in the metal cylinder, and a plunger having an end positioned against the heat sensitive material, wherein the heat-sensitive material comprises a low-melting point alloy composed of Sn in an amount of 0.1-2.0% by mass, Bi in an amount of 31-37% by mass and In for balance.

2. A sprinkler head in accordance with claim 1, wherein said heat-sensitive material further includes at least one or more elements for improving the strength in a total amount no more than 2.0% by mass, said at least one or more elements being selected from a group of elements consisting of Cu in an amount of 0.1-1.0% by mass, Sb in an amount of 0.2-2.0% by mass, Ge in an amount of 0.1-1.0% by mass, Ag in an amount of 0.1-0.7% by mass, Au in an amount of 0.1-0.6% by mass, Zn in an amount of 0.2-0.6% by mass, La group in an amount of 0.01-0.1% by mass, and Ni in an amount of 0.02-0.1% by mass.

3. A sprinkler head in accordance with claim 1, wherein said heat-sensitive material further includes at least two or more elements for improving the strength in a total amount no more than 2.0% by mass, said at least two or more elements being selected from a group of elements consisting of Cu in an amount of 0.1-1.0% by mass, Sb in an amount of 0.2-2.0% by mass, Ge in an amount of 0.1-1.0% by mass, Ag in an amount of 0.1-0.7% by mass, Au in an amount of 0.1-0.6% by mass, Zn in an amount of 0.2-0.6% by mass, La group in an amount of 0.01-0.1% by mass, and Ni in an amount of 0.02-0.1% by mass.

4. A sprinkler head adapted for a yield temperature in a range of 90-95° C., the sprinkler head being a compression type sprinkler head and including a main body defining a valve seat, a valve element normally seated on the valve seat, and a heat-sensitive decomposition structure connected to the valve element, the heat-sensitive decomposition structure including a metal cylinder, a heat sensitive material disposed in the metal cylinder, and a plunger having an end positioned against the heat sensitive material, wherein the heat-sensitive material comprises a low-melting point alloy composed of Zn in an amount of 0.05-0.4% by mass, Bi in an amount of 47-55% by mass and In for balance.

5. A sprinkler head in accordance with claim 4, wherein said heat-sensitive material further includes at least one or more elements for improving the strength in a total amount no more than 2.0% by mass, said at least one or more elements being selected from a group of elements consisting of Cu in an amount of 0.1-1.0% by mass, Sb in an amount of 0.2-2.0% by mass, Ge in an amount of 0.1-1.0% by mass, Ag in an amount of 0.1-0.7% by mass, Au in an amount of 0.1-0.6% by mass, Zn in an amount of 0.2-0.6% by mass, La group in an amount of 0.01-0.1% by mass, and Ni in an amount of 0.02-0.1% by mass.

6. A sprinkler head in accordance with claim 4, wherein said heat-sensitive material further includes at least two or more elements for improving the strength in a total amount no more than 2.0% by mass, said at least two or more elements being selected from a group of elements consisting of Cu in an amount of 0.1-1.0% by mass, Sb in an amount of 0.2-2.0% by mass, Ge in an amount of 0.1-1.0% by mass, Ag in an amount of 0.1-0.7% by mass, Au in an amount of 0.1-0.6% by mass, Zn in an amount of 0.2-0.6% by mass, La group in an amount of 0.01-0.1% by mass, and Ni in an amount of 0.02-0.1% by mass.

* * * * *